US005093184A

United States Patent [19]

Edwards

[11] Patent Number: 5,093,184

[45] Date of Patent: Mar. 3, 1992

[54] SECURITY PAPER WITH METALLIC PATTERNED ELONGATED SECURITY ELEMENT

[75] Inventor: David J. Edwards, Overton, United Kingdom

[73] Assignee: Portals Limited, Hampshire, United Kingdom

[21] Appl. No.: 530,198

[22] Filed: May 29, 1990

[30] Foreign Application Priority Data

Jun. 2, 1989 [GB] United Kingdom ..... 8912750

[51] Int. Cl.[5] ..... B42D 15/00

[52] U.S. Cl. ..... 428/195; 428/203; 428/204; 428/209; 428/916; 428/292; 428/464; 428/192; 428/131; 428/137; 428/343; 428/379; 428/380; 428/381; 428/220; 283/57; 283/58; 283/83; 283/94; 283/93; 283/901; 283/902; 283/85; 283/91; 283/114

[58] Field of Search ..... 428/195, 203, 204, 209, 428/916, 292, 464, 192, 131, 137, 343, 379, 380, 381, 220; 283/57, 58, 83, 94, 93, 901, 902, 85, 91, 114

[56] References Cited

U.S. PATENT DOCUMENTS

| | | | |
|---|---|---|---|
| 4,183,989 | 1/1980 | Tooth | 428/916 X |
| 4,186,943 | 2/1980 | Lee | 283/58 X |
| 4,371,196 | 2/1983 | von Kempski et al. | 428/916 X |
| 4,455,039 | 6/1984 | Weitzen et al. | 283/83 |
| 4,527,383 | 7/1985 | Bingham | 428/916 X |
| 4,618,167 | 10/1986 | Whitehead | 283/75 |
| 4,756,557 | 7/1988 | Kaule et al. | 283/85 |
| 4,761,205 | 8/1988 | Crane | 428/916 X |
| 4,897,300 | 1/1990 | Boehm | 428/916 X |
| 4,943,093 | 7/1990 | Melling et al. | 283/83 |

FOREIGN PATENT DOCUMENTS

| | | |
|---|---|---|
| 0059056 | 5/1985 | European Pat. Off. . |
| 0229645 | 7/1987 | European Pat. Off. . |
| 1095286 | 12/1967 | United Kingdom . |
| 1552853 | 9/1979 | United Kingdom . |
| 1604463 | 12/1981 | United Kingdom . |
| 2119312 | 11/1983 | United Kingdom . |

*Primary Examiner*—Ellis P. Robinson
*Assistant Examiner*—William P. Watkins, III
*Attorney, Agent, or Firm*—Bacon & Thomas

[57] ABSTRACT

This invention is concerned with security paper for bank notes, cheques and like documents in a security strip of enhanced security which is more difficult to counterfeit than the present bank notes containing window threads. Security papers according to the invention comprise at least one elongated security element which security element is partially embedded within said paper with portions thereof being exposed at the surface of the paper at spaced intervals along the length of the security element at windows in the paper, said security element being visually detectable in transmitted light and being visible in the windows of the paper in reflected light, wherein the said security element comprises a plurality of layers including a support layer and metallic regions such that when the exposed portions of the security element are viewed in the reflected light there is visible to the unaided eye in each window at least two metallic areas which form repeating patterns along the length of the element, with the said metallic areas being of different color.

21 Claims, 4 Drawing Sheets

SECURITY PAPER WITH METALLIC PATTERNED ELONGATED SECURITY ELEMENT

Figure 1:
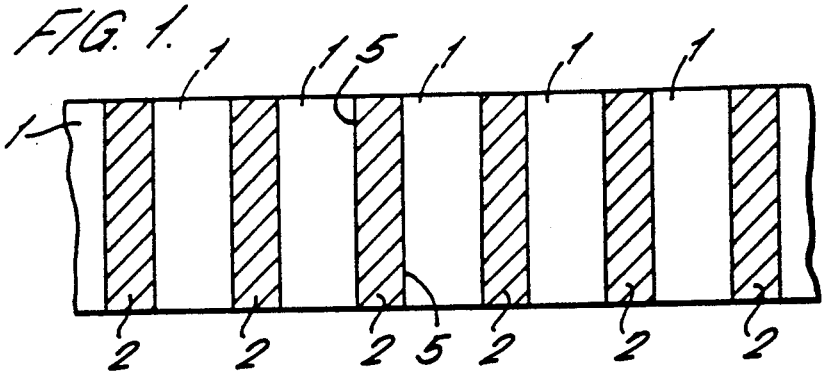

This invention is concerned with security paper for bank notes, cheques and like documents. It is widely known to use in bank notes security devices such as strips or threads which are made from a transparent film provided with a continuous reflective metal layer, vacuum deposited aluminium on polyester film being the commonest example. Bank notes made from such paper have been in general circulation in many countries for many years. When such security devices are embedded in the security paper and the paper is subsequently printed to provide the security document, eg. a bank note, the thread cannot be readily discerned in reflected light but is immediately apparent as a dark image when the document is viewed in transmitted light.

Further, in our previous British patent specification no. 1095286 (Ottway) there is described and claimed a security device for use in security paper comprising a continuous fine security ribbon having a width of substantially 0.75 mm and having printed thereon a design, lettering or pattern comprising printed characters of a height of substantially 0.4 mm. The security ribbons of Ottway may be made of metal foil, which may be aluminium, and furthermore may be in the form of a laminate. The printed design, lettering or pattern as disclosed in the Ottway specification is very small, ie. 0.4 mm, with the width of the device being 0.75 mm. In general, the lettering or other printing of the device is not readily visible without an aid to vision, such as a magnifying glass or microscope.

In recent times, in order to enhance the security of security documents, especially bank notes against modern counterfeiting techniques making use of sophisticated colour separation, printing and colour photocopier technology, it has become common to use a security thread comprising a thin layer of aluminium on a plastic support which is exposed on one side of the sheet at intervals along the length of the thread, the region of exposure being referred to as a window. British patent specifications nos. 1552853 and 1604463 disclose bank notes containing such windows. Paper for use in producing such bank notes can be made using the methods disclosed in our European patent specification no. 59056.

This development has resulted in enhanced security and windowed paper has been used for bank notes by many countries. A bank note of this type provides added security against counterfeiters as, when viewed in transmitted light the strip is seen as a dark line, and, when viewed in reflected light on the appropriate side the bright shiny aluminium portions which are exposed at the windows are readily visible. However, there is a need for even greater security by the use of more sophisticated security devices in order to render the task of a would-be counterfeiter more difficult as the reflected light appearance of the exposed aluminium portions of a security device can be simulated to a degree by modern materials and techniques, for example by the use of hot foil stamping.

The present invention therefore is concerned with providing a security strip of enhanced security to provide security paper for bank notes, cheques and the like which is even more difficult to counterfeit than the present bank notes containing windowed thread.

An aim of the present invention is to create a security element for windowed security paper comprising adjacent bright shiny areas in contrasting colours along its length. Preferably the boundaries between these areas will be intersected by the slit edges of the element and it is inherent in such a design that the adjacent bright shiny areas will b seen by the naked eye to be in perfect register. Moreover, a simulation in which the registration is even slightly imperfect should be readily apparent to untrained members of the public.

Accordingly, the present invention provides security paper which comprises at least one elongated security element of a width of preferably at least 0.8 mm, which security element is partially embedded within said paper with portions thereof being exposed at the surface of the paper at spaced intervals along the length of the security element at windows in the paper, said security element being visually detectable in transmitted light and being visible in the windows of the paper in reflected light, wherein the said security element comprises a plurality of layers including a support layer and metallic regions such that when the exposed portions of the security element are viewed in reflected light there is visible to the unaided eye in each window at least two metallic areas which form repeating patterns along the length of the element, with the said metallic areas being of different colour.

Thus to simulate the reflected light appearance of the windowed regions of the paper, the counterfeiter must apply not one but at least two reflective materials of different colours. This will involve two or more separate operations e.g. using a foil stamping machine and two different coloured metallic stamping foils. Thus to simulate a pattern comprising alternate bars across the security element of, say, aluminium and gold appearance (see example 1 and FIG. 1 below), the counterfeiter may first stamp one colour e.g. "aluminium" from an "aluminium" foil to represent the full length of the exposed thread in the window regions and secondly a multiplicity of smaller "gold" bars from a "gold" foil superimposed on the previously applied "aluminium" regions. The registration of such machinery is imperfect e.g. a tolerance of 0.1 mm is the best that can be achieved. Therefore there will be some misregister between the simulated aluminium and gold bars which will be readily apparent to the naked eye, particularly where there is misregister in the transverse direction at right angles to the security element.

The counterfeiter may attempt to overcome this limitation by reducing the width of the, say, simulated gold bars to less than that of the aluminium bars; however there will then be a region of clear aluminium on at least one side edge of the simulated gold bars whereas for the genuine item, the gold bars run right to the edge of the security element.

Figure 6:
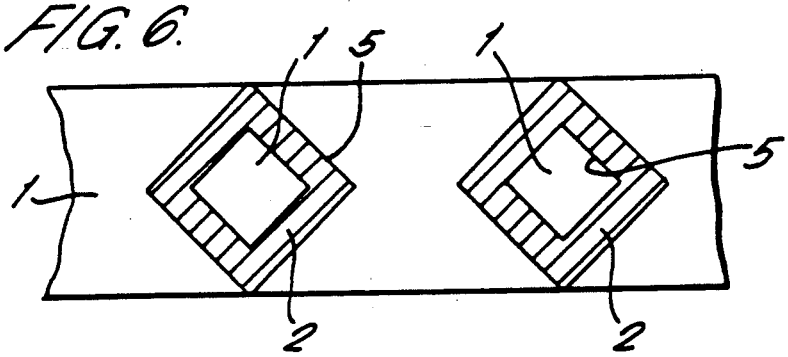
Figure 7:
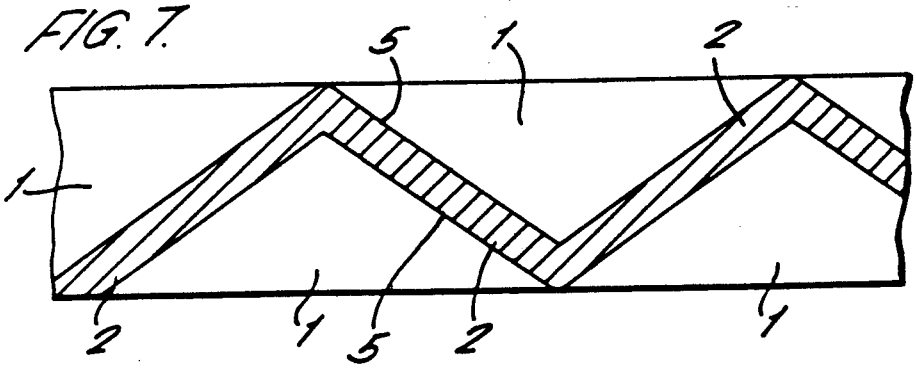

By making use of precision register slitting techniques to slit individual security elements from a web, designs such as shown in FIGS. 6 and 7 can be accomodated whereby a point or other identifiable part of the metallised area of one or more colours is located exactly on the edge of the security element. A simulation of this by a counterfeiter will result in the point either running over the edge of the other metallised colour or within it thus leaving a region between the point and the edge of the simulated element; in either case, the simulation is readily discernible to the naked eye.

As indicated above the width of the security element is preferably at least 0.8 mm and is more preferably from 1 to 3 mm, but even wider strips may be used, for example 5 or 8 mm. In those cases where the width of the security element is not more than 3 mm, the security element may be incorporated into paper using the methods disclosed in our European patent specification no. 59056. The paper according to the present invention may however be made by a wet lamination technique where two still moist layers are united around a security element, at least one of said layers comprising windows which serve to expose the security element when the two layers are united; a wet lamination technique may be effected by means of the procedures described in European patent specification no. 229645. A dry lamination technique may be used to unite two layers around a security element to form paper in accordance with the invention and in general such dry lamination will use an adhesive.

It is preferred that the security element of paper in accordance with this invention has a support layer which carries on one side spaced apart selectively metallised areas which form a repeating pattern along the length of the element, and on the other side of the support layer there is a continuous metal layer which, when viewed from the selectively metallised side of the security element provides two metallic areas in the window regions of the security paper which are of different colour and are visible to the naked eye; a security element as described may have selectively metallised regions of aluminium and the continuous metallic layer may be formed of a metal having a different colour. Alternatively, in another embodiment the selectively metallised regions are aluminium and the continuous metallic layer is also aluminium, there being positioned between the two layers of aluminium a transparent layer which is coloured such that the continuous metallic layer when viewed from the selectively metallised side of the security element has the appearance of being a different colour to that of aluminium. The metallic areas may form a repeating pattern along the length of the element; alternatively one of the areas may be constituted by numbers or letters of the alphabet or by other characters.

Between the different coloured areas are formed boundaries, of which at least one boundary preferably extends to one or both edges of the security element. In a further preferred embodiment all of the boundaries extend from one edge of the security element to the other edge across its width.

For a document which has a high value but which is subject to little wear and tear, a so-called one-trip document, it is not necessary to bond the security element to the paper to which it is in contact. However, for bank notes and like documents which are subjected to a great deal of wear and tear it is highly desirable in order for the bank note to have a reasonably long life for the security element to be bonded to the paper by means of an adhesive layer present on both sides of the security element across its width.

The security element which is positioned in the paper in accordance with this invention may be asymmetric in appearance in which case great care is needed to ensure that the correct side of the security element is uppermost and is positioned in the windows of the paper. It is however not easy to ensure that the correct side of an asymmetric security element is uppermost and exposed to view in the window. Accordingly it is preferred, at least from the point of view of ease of manufacture of the paper in accordance with this invention, that the security element is substantially symmetrical from the visual point of view so that the appearance of the element is the same when viewed from either side prior to insertion into paper. It is not necessary for visually symmetrical security elements to be symetrical about a central plane, but a security element which is symmetrical about a central plane is a very convenient element to be used in the manufacture of security paper in accordance with this invention, particularly using the procedures and methods disclosed in our European patent specification no. 59056. Such a truly symmetrical security element may be formed by uniting with an adhesive back to back two security elements as described above.

In order to enhance the security of the paper in accordance with this invention it is preferred that there is exposed in each window of the paper at least three metallic areas of different colour, two of which may be the same, although more than two metallic colours may be employed The pattern which is exposed in the windows of the paper may denote bank notes of different denomination by virtue of the colours used or the nature of the pattern In one form of the invention the metallic areas exposed at the windows may provide a specific bar coding with bank notes of different denominations having a different bar coding by means of, for example the use of different lengths (i.e. the dimension parallel to the security element) for the differently coloured metallic areas.

In one form of the invention, the paper is provided with a security element having a continuous aluminium layer which is capable of reflecting incident light and which also transmits a visually detectable amount of the light which reaches said continuous layer; the continuous layer may accordingly have properties similar to those of a see-through mirror. Typically but not exclusively such a continuous metal layer will have an optical density in the range 0.15–1.0. Preferably the optical density should be in the range 0.3–0.7.

The length of the windows of the paper of this invention may vary in size and various widths of security element may be provided, but in general it is preferred that the length of the windows is from 2 to 8 mm and more preferably 3 to 5 mm and the width of the security element preferably 1 to 3 mm.

In the security elements used in the paper of this invention it is important that the metallic layers provide a surface which will produce reflection of a substantially specular nature. It will be obvious to those skilled in the art that the reflecting surfaces should for best performance be as smooth as possible and accordingly will appear bright and shiny. Aluminium which has been vacuum deposited on a substrate, such as a film of polyester, has excellent reflective properties and is preferred generally in the security elements described herein. However, it is possible also to use as the reflecting surface a printed or coated metallic layer provided by metal particles having reflective surfaces which are disposed within a transparent polymeric layer e.g. a highly reflective metallic ink.

The invention also includes a security document, especially a bank note, when produced by printing on paper in accordance with this invention.

Figure 2:
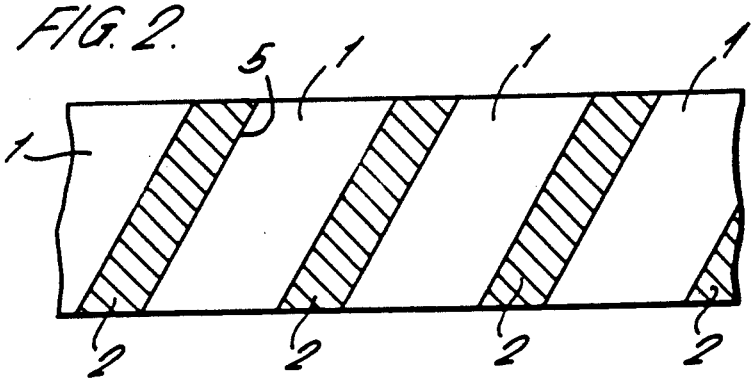
Figure 3:
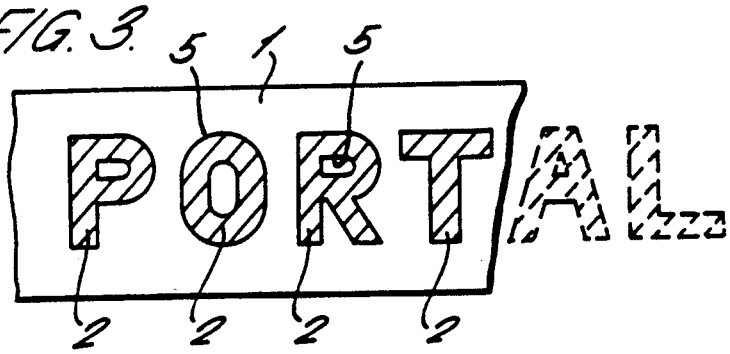

The invention will now be described with reference to FIGS. 1 to 7 and *7a* of the accompanying drawings. Each of these figures illustrates a security element for use in producing security paper in accordance with this invention. In these seven FIGS. 1 indicates a metallic area where light is reflected from a continuous metal layer and which is positioned on one side of a polyester film. The metallic areas 2 are the selectively metallised areas which may be produced by selectively demetallising a continuous layer by using techniques well known to those skilled in the art. As is to be noted from an examination of these seven figures, the metallic areas may take different forms and those illustrated in FIGS. 1, 2, 4 and 5 are preferred as they involve a pattern where the at least two metallic areas 1, 2 have a boundary 5 which extends to the slit edges of the security element. FIG. 3 illustrates how letters may be used in the security element to provide a name such as the name of the manufacturer of the paper or the name could indicate a bank note issuing authority or note denomination. In FIG. 3 however the boundaries 5 do not extend to the slit edges of the security element. The repeating patterns illustrated in FIGS. 6 and 7 are useful in presenting a would-be counterfeiter with a difficult pattern to copy but these two security elements provide complications as they need exact register slitting when the security element is formed by slitting a web into the individual security elements which are to be used as strips or threads in the paper. A very precise slitting technique with accurate registering is necessary in order to achieve the patterns of the elements shown in FIGS. 6 and 7. In the configuration shown in FIG. 6 not all of the boundaries 5 extend to the edges of the security element.

Figure 7A:
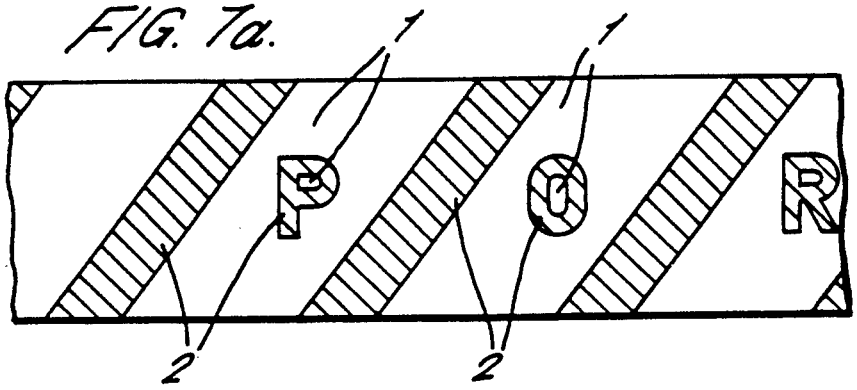

Letters such as those shown in FIG. 3 can be combined with other designs e.g. those of FIGS. 1–2, 4–7 such that the letters perceived in metallic colour 2 are present within regions of metallic colour 1, see FIG. 7*a*.

Figure 8:
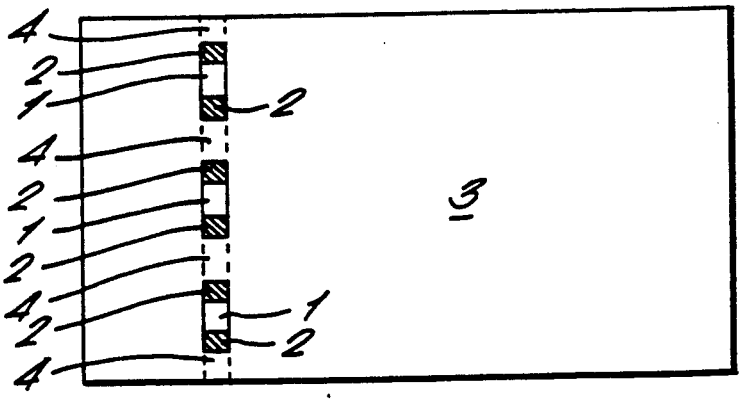

FIG. 8 illustrates a piece of security paper 3 suitable for use in printing a bank note. In particular in FIG. 8 there are shown three windows which expose three regions of the security element, each region having adjacent metallic areas of different colour as indicated by reference numerals 1 and 2. The buried portions of the security element are indicated by the reference numerals 4.

The invention will now be illustrated further by reference to FIGS. 9, 10, 11 and 12, each of which illustrate in longitudinal section security elements in accordance with this invention.

Figure 9:
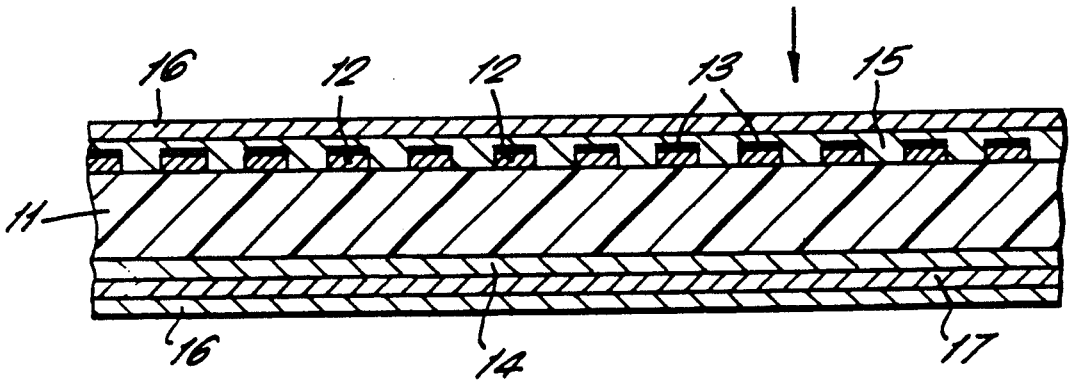

With reference to FIG. 9, a polyethylene terephthalate (polyester) support 11 carries on its upper surface areas of metal 12 which extend across the security element in the transverse direction. The areas of metal 12 may be of any suitable colour and they may be opaque or have a translucent quality by virtue of the metal being in the form of exceedingly thin film. Overlying the metallic areas 12 is a lacquer which may be clear or coloured, and may be fluorescent e.g. a resist layer 13 used to create regions 12 by a demetallisation process. On the lower side of the polyester support 11 is a continuous layer of metal 14 which may be either opaque or translucent but which must provide a different reflective appearance from areas 12 when viewed from the direction of the arrow. The two layers 16 are adhesive layers which are suitably colourless and clear. Layers 1 and 17 are optional layers of clear lacquer which may be coloured and/or fluorescent. In one modification of the security element illustrated in FIG. 9, the optical properties of layers 15 and 17 may be incorporated in layers 16, thus dispensing with layers 15 and 17. The colours of layers 13, 15 and 17 (or in layer 16 in place of 15 and 17 in the modification just described) may vary independently whether viewed with visible or fluorescent illumination. The substrate 11 is preferably polyester, but other suitable polymeric substrates may be used; layer 11 may optionally comprise a dye.

There will now be described with reference to FIG. 9 four examples:

EXAMPLE 1

In this example the layers 16 are colourless and clear and are formed of an adhesive which has good bonding properties with paper fibres. The metallic areas 12 and the metallic layer 14 are opaque aluminium with an optical density of 2.0 to 2.5. The metallic areas 12 are formed by demetallising film with an aluminium coating by known techniques to provide a pattern as illustrated in FIG. 1 as referred to above. Layer 11 is a clear polyester layer which comprises a yellow dye. The layer of lacquer 15 is colourless but contains a fluorescing blue substance. The layer of lacquer 17 is colourless and contains a fluorescing yellow substance. Layer 13 is clear and colourless. The security element is inserted into paper such that the selectively metallised regions 12 are uppermost and exposed in the window regions of the security paper.

Overall the security element of this example is opaque to transmitted light and when so viewed from either side will appear as a continuous dark strip in the paper. However, when the security element is viewed through the window from the direction of the arrow by visible reflected light metallic areas 12 will be highly reflective silver in appearance and those portions of the continuous metal layer 14 which are visible when viewed from the direction of the arrow will be highly reflective gold and provide a sharp contrast to the areas of metal 12. In the non-windowed areas of the paper comprising the security element illustrated in FIG. 9 the distinctive pattern of the element will also be discernible to an extent dependent upon the metallic colours of the security element and the thickness of overlying fibre. When paper incorporating the security element is viewed from the windowed side by ultra-violet light, the security element will have a continuous blue appearance, which is bright in the windowed areas and the fluorescence will also be discernible in the non-windowed areas. When the security paper is viewed from the side opposite to the arrow, the non-windowed side, the security element will have the appearance of a simple metallised strip in visible light and will fluoresce yellow in ultra-violet light.

EXAMPLE 2

In this example with reference to FIG. 9 the adhesive layers 16 are clear and colourless selectively metallised areas 12 are opaque aluminium with an optical density of 2.0 to 2.5 and layer 14 also has a continuous layer of lightly metallised aluminium with an optical density of 0.6 which is highly reflective but translucent. In this example layers 15 and 17 are omitted and the support layer 11 is clear polyester comprising a green dye. Layer 13 is clear and colourless. The security element is inserted into paper such that the selectively metallised regions 12 are uppermost and exposed in the window regions of the security paper.

Figure 4:
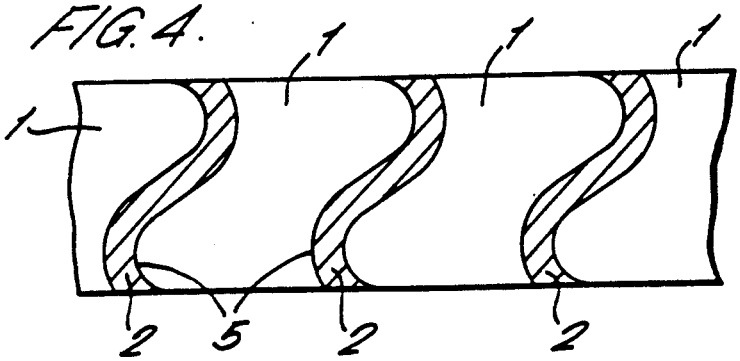
Figure 5:
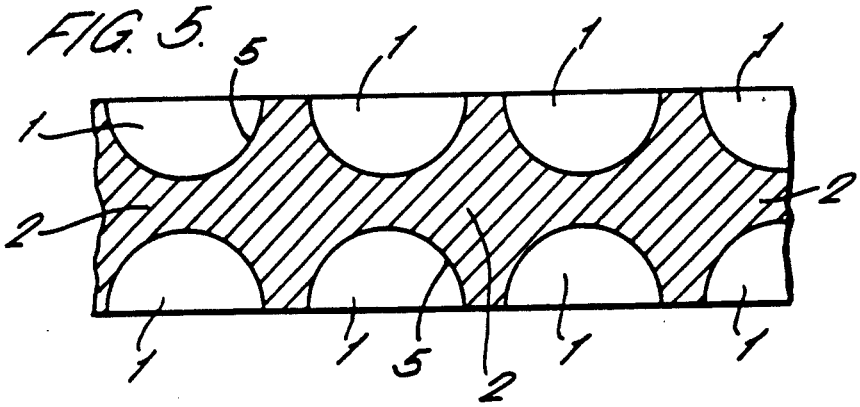

When this embodiment is viewed from the windowed side by visible reflected light, the pattern, which may be a pattern as illustrated in FIG. 4 of the drawings, will be visible in the windowed area as highly reflective adjacent areas of metallic green and silver which are in sharp contrast. The pattern is also discernible in the areas of the paper where the security element is embedded. When the paper is viewed from the non-windowed side by visible reflected light the thread will have the appearance of a simple metallised strip. When viewed from the non-windowed side by transmitted light, the metallic areas 12 will be apparent as dark areas against a green background. When the paper incorporating the security element of this example is viewed from the windowed side by transmitted light, the green reflective areas will remain bright and green whereas the silver reflective areas will become dark.

EXAMPLE 3

In this example layers 16 are clear and colourless. Again layers 15 and 17 are omitted and support layer 11 is colourless polyester. The metallised areas 12 are produced by demetallising continuous aluminium layer to provide a pattern as shown in FIG. 2 of the drawings. Layer 13 is clear and colourless. A continuous metallic layer 14 is a layer of vacuum deposited copper with an optical density of 2.5. The security element is inserted into paper such that the selectively metallised regions 12 are uppermost and exposed in the window regions of the security paper.

A security element according to this invention is totally opaque to transmitted light and therefore appears in the paper when viewed in such light as a dark strip. When paper incorporating the security element is viewed with reflected light on the windowed side the pattern as illustrated in FIG. 2 is apparent with a contrasting pattern of highly reflective silver and copper areas. This pattern is also discernible in the areas of the paper where the security element is embedded. On the reverse, non-windowed side of the paper the security element when viewed in reflected light appears as a simple strip of embedded copper.

EXAMPLE 4

In this example, the security element is as described in example 3 except that layer 13 contains an agent which fluoresces blue under ultra-violet light. When the security paper is illuminated with reflected ultra-violet light on the side shown by the arrow, the regions 12 which are highly reflective silver in reflected visible light are seen to be blue against a dark background.

Figure 10:
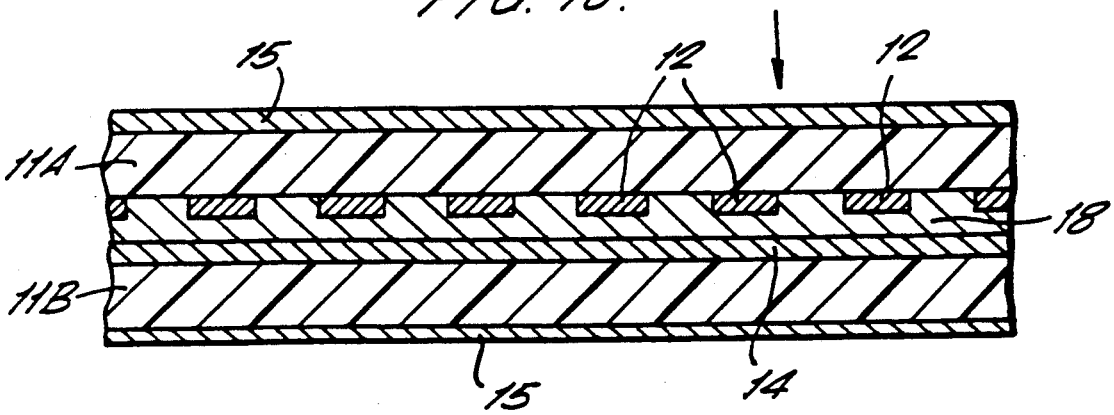

A further form of security strip suitable for use in accordance with this invention is illustrated in FIG. 10. In this security element layers 11 are both support layers. The upper support layer 11A carries the selectively metallised areas 12 and these may be opaque or translucent; the lacquer layers 15 on either side of the security element are each independently clear or coloured, and may be fluorescing. Layer 14 is a continuous metallised layer of a different colour to areas 12 which may be opaque or translucent by virtue of being a thin film of metal which will have been provided by vacuum deposition onto the lower support layer 11B. In producing the security element as illustrated in FIG. 10 the upper support layer 11A with the metallic areas 12 will be united with the lower support layer 11B carrying continuous metallic layer 14 by use a laminating adhesive 18. The layers used in the security element illustrated in FIG. 10 may be varied to provide different optical effects in a similar manner to that described in examples 1, 2, 3 and 4; for example, the lamination adhesive 18 may be coloured and the desired effects obtained with metallised layer 14 of the same type as metallised areas 12. In this embodiment it is optional whether the layer 13 on the metallised areas 12 is retained as in FIG. 9 or whether it is removed as shown in FIG. 10. If the layer 13 is retained it could be clear or coloured with a dye or a fluorescing agent.

Figure 11:
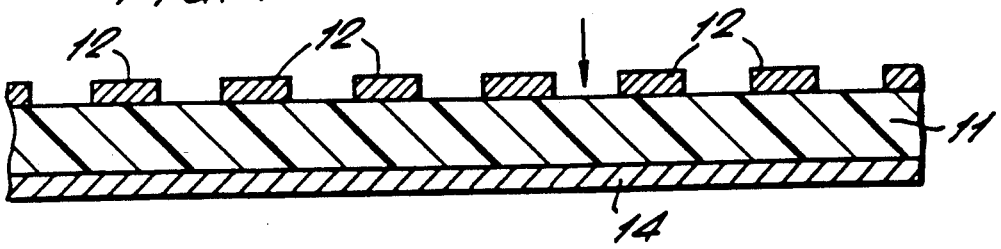

A further security strip for use in accordance with this invention is illustrated in FIG. 11. The support layer 11 is polyester. The selectively metallised areas 12 are aluminium and layer 14 is a continuous opaque layer of metal of contrasting colour to aluminium and may be copper, gold or the like. Again it is optional whether the resist layer 13 is removed or retained, clear or coloured.

It will be appreciated that the security element according to FIG. 11 must be introduced into the security paper during manufacture such that the upper side with the selectively metallised areas is uppermost and exposed at the windows of the paper.

Figure 12:
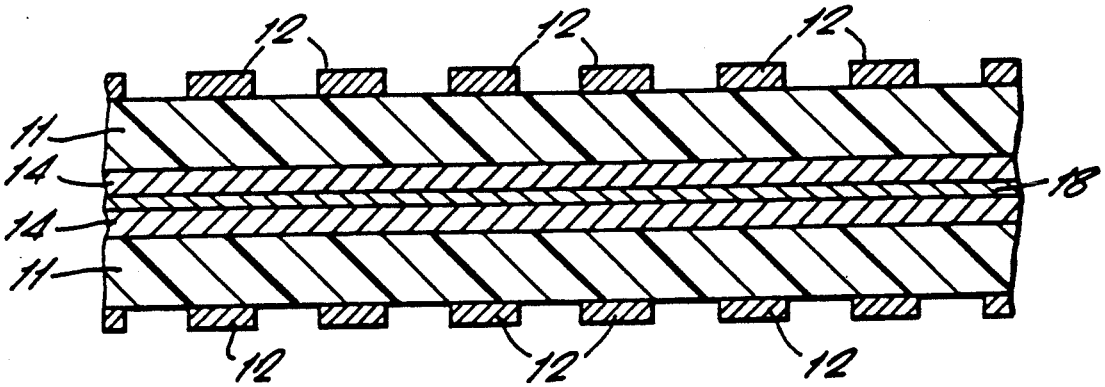

In FIG. 12 there is illustrated a preferred security element to be used in the production of paper in accordance with this invention where the security element is symmetrical about a central plane. This security element is formed by laminated back to back two security elements as illustrated in FIG. 11, the lamination being effected with the use of adhesive layer 18. Optionally, one of layers 14 may be omitted to produce a security element which is visually but not physically symmetric. Again the retention and colouring of resist layer 13 is optional. Adhesive layers 16 as described for examples 1–3 may also be applied to the external surfaces of the laminate.

In a modification of the security element illustrated in FIG. 11 the selectively metallised areas 12 are aluminium and the support layer is dyed with a yellow dye; the continuous metallic layer is also aluminium. When paper comprising this security strip is viewed from the upper side through windows of the security paper the contrasting patterns are of bright silver and gold. Two security elements as described in this modification may be positioned back to back to form a symetrical security element which does not require careful orientation when it is introduced into paper in accordance with the invention.

Various modifications in the design of the security elements described above may be employed in the security papers of the invention. For example, a security element could comprise a polyester support having on one side a continuous aluminium layer and on the opposite side the support is provided with a selectively metallised area by printing with a metallic ink, such as gold ink, to provide a security strip having a contrasting pattern of gold coloured areas and silver coloured areas when viewed in reflected light from the gold ink side; optionally the polyester support comprises a dye such that the pattern consists of gold areas and areas of another reflective colour. Furthermore, the areas provided by printing with a metallic ink may be printed directly onto an aluminium layer which is supported by a polyester film.

In a further form of security element in accordance with this invention a clear polyester support layer is provided with selectively metallised areas of aluminium by demetallising a continuous layer of aluminium. This demetallised element is then laminated with adhesive to a layer of dyed polyester carrying on its other side a continuous layer of opaque aluminium such that the selectively metallised regions are between the two layers of polyester. When the security element having the design described is viewed at the windows of security paper through the outer clear polyester layer the resulting pattern is composed of aluminium areas and coloured reflective areas. As the selectively metallised areas of aluminium are protected by the outer layer of polyester there is enhanced protection against mechanical and/or chemical attack.

Figure 13:
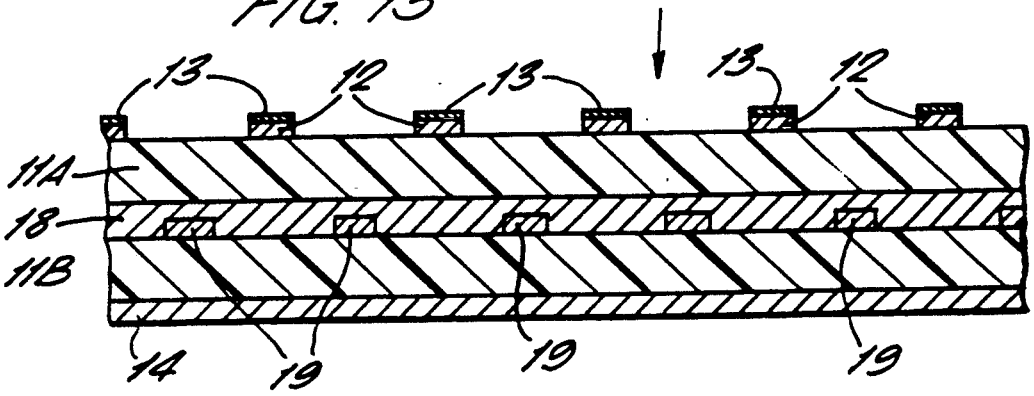

In a further embodiment of the invention, a security element comprises three or more regions, each with its own reflective colour. This is illustrated in FIG. 13. Layer 11A comprises clear polyester which has been selectively demetallised to produce regions of opaque aluminium 12 on one surface. A blue transparent coloured layer 13 is retained on the outer surface of regions 12. A second layer of clear polyester 11B is also selectively demetallised to produce regions of opaque aluminium 19.

The two polyester plies are then laminated as shown using a clear adhesive 18. The lower surface of the laminate is then supplied with a continuous opaque vacuum deposition of another metal e.g. copper 14.

The regions 12 and 19 are arranged in a bar pattern extending the full width of the security element such that regions 19 do not lie under regions 12.

When the security element is viewed by reflected light in the window regions of the security paper from the direction of the arrow shown, regions 12 have a blue metallic appearance, regions 19 have a silver appearance and the intervening regions have a copper appearance from layer 14.

It is to be appreciated that in practice the security elements of this invention are formed by producing webs of material comprising the various layers and embodying across the width of the web the pattern which, after slitting the web into strips or threads, provides the security element to be used in the paper of this invention.

It is to be understood further, that the present invention includes novel security threads as described herein.

Throughout this specification, it is to be understood that the terms "fluorescence" and "fluorescent" include phosphorescence and phosphorescent. Furthermore, the stimulating radiation for fluorescent effects is not restricted to ultra-violet radiation but includes infra-red or other suitable radiation.

I claim:

1. Security paper comprising
a) at least one surface for printing,
b) an elongate security element having a width,
c) some portions of said security element along its length being embedded within the paper and others being exposed at windows at spaced intervals in the surface of the paper,
said security element comprising
a) at least one support layer,
b) a metallic layer,
c) secondary metallic areas which, in combination with ares of the metallic layer, form a repeating pattern along the length of said security element and which pattern is visible in said windows in reflected light to the unaided eye, the size and shape of the repeating pattern being selected such that at least two metallic areas of different colour and reflective appearance can be seen at each window,
d) boundaries in said visible pattern being formed between the different coloured metallic areas, at least one of said boundaries ending at one or both of the edges of said element, said edges being perpendicular to said width.

2. Security paper as claimed in claim 1 in which the metallic layer of the security element has an optical density such that no light is transmitted through the security element.

3. Security paper comprising
a) at least one surface for printing,
b) an elongate security element having a width,
c) some portions of said security element along its length being embedded within the paper and others being exposed at windows at spaced intervals in the surface of the paper,
said security element comprising
a) at least one support layer,
b) a metallic layer,
c) secondary metallic areas which, in combination with areas of the metallic layer, form a repeating pattern along the length of said security element and which pattern is visible in said windows in reflected light to the unaided eye, the size and shape of the repeating pattern being selected such that at least two metallic areas of different colour and reflective appearance can be seen at each window,
d) boundaries in said visible pattern being formed between the different coloured metallic areas said boundaries extending from one edge of the element to the other edge across its width.

4. Paper claimed in claim 1 wherein the width of the security element is from 1 to 8 mm.

5. Paper as claimed in claim 1 wherein the width of the security element if from 1 to 3 mm.

6. Paper as claimed in claim 1 wherein the support layer carries on one side spaced apart, selectively metallised areas which form a repeating pattern along the length of the element, and on the other side of the support layer there is a continuous metal layer, such that, when viewed from the selectively metallised side of the element, two metallic areas of different colour are visible.

7. Paper as claimed in claim 6 wherein the selectively metallised regions are aluminium and the continuous metallic layer is a metal having a different colour.

8. Paper as claimed in claim 6 wherein the selectively metallised regions are aluminium and the continuous metallic layer is also aluminium, there being positioned between the two layers of aluminium a transparent layer which is coloured such that the continuous metallic layer, when viewed from the selectively metallised side has the appearance of being a different reflective colour to that of aluminium.

9. Paper as claimed in claim 1 wherein all of the boundaries between the metallic areas extend from one edge of the element to the other edge across its width.

10. Paper as claimed in claim 1 wherein the security element is bonded to the paper by means of an adhesive layer present on either side of the element across its width.

11. Paper as claimed in claim 1 wherein the security element is substantially visually symmetrical so that the appearance of the element is the same when viewed from either side.

12. Paper as claimed in claim 11 wherein the security element is symmetrical and is formed by uniting with an adhesive back-to-back two security elements.

13. Paper as claimed in claim 1 wherein there is exposed in each window of the paper at least three metallic areas of different colour.

14. Paper as claimed in claim 1 which comprises a continuous aluminium layer wherein said layer is capable of reflecting incident light and which also transmits a visually detectable amount of the light which reaches said continuous layer.

15. Paper as claimed in claim 14 wherein the continuous metal layer has an optical density in the range 0.15–1.0.

16. Paper as claimed in claim 14 wherein the continuous metal layer has an optical density in the range 0.3–0.7.

17. Paper as claimed in claim 1 wherein the length of the windows is from 2 to 8 mm.

18. Paper as claimed in claim 1 wherein the length of the windows is from 3 to 5 mm.

19. Paper as claimed in claim 1 which comprises a continuous metallic layer or selectively metallised regions which are provided by metal particles having reflective surfaces which are disposed within a transparent polymeric layer.

20. A security document when produced by printing on paper as claimed in claim 1.

21. A security document as in claim 20 wherein said document is a bank note.

* * * * *